US012503933B2

(12) United States Patent
Stephens et al.

(10) Patent No.: US 12,503,933 B2
(45) Date of Patent: Dec. 23, 2025

(54) ELECTRIC SUBMERSIBLE PUMP GAS EVACUATION SYSTEM

(71) Applicant: Baker Hughes Oilfield Operations LLC, Houston, TX (US)

(72) Inventors: Kyle Stephens, Claremore, OK (US); Brett Williams, Houston, TX (US); Hui Gao, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 6 days.

(21) Appl. No.: 18/379,139

(22) Filed: Oct. 11, 2023

(65) Prior Publication Data

US 2025/0122784 A1 Apr. 17, 2025

(51) Int. Cl.
*E21B 43/12* (2006.01)
*E21B 43/38* (2006.01)

(52) U.S. Cl.
CPC ..... *E21B 43/128* (2013.01); *E21B 43/38* (2013.01); *E21B 43/12* (2013.01)

(58) Field of Classification Search
CPC ..... E21B 43/128; E21B 43/12
See application file for complete search history.

(56) References Cited

U.S. PATENT DOCUMENTS

| | | | |
|---|---|---|---|
| 2,355,259 | A | 8/1944 | Cotesworth et al. |
| 2,929,501 | A | 3/1960 | Fenske et al. |
| 3,291,057 | A | 12/1966 | Carle |
| 3,986,552 | A | 10/1976 | Scott |
| 4,253,481 | A | 3/1981 | Sarlls |
| 5,207,810 | A | 5/1993 | Sheth |
| 5,271,725 | A | 12/1993 | Freet et al. |
| 5,344,269 | A | 9/1994 | Banks |
| 5,433,269 | A | 7/1995 | Hendrickson |

(Continued)

FOREIGN PATENT DOCUMENTS

| | | | |
|---|---|---|---|
| CN | 108386160 | A | 8/2018 |
| GB | 2365046 | A | 2/2002 |

(Continued)

OTHER PUBLICATIONS

International Search Report and Written Opinion for PCT/US2024/050846 mailed Jan. 14, 2025.

*Primary Examiner* — Tara Schimpf
*Assistant Examiner* — Daniel T Craig
(74) *Attorney, Agent, or Firm* — Baker Hughes Company

(57) ABSTRACT

A pumping system deployed in a wellbore is designed for producing two-phase fluids through production tubing to a wellhead, while protecting downhole tubulars and equipment from corrosive gases from the wellbore. The pumping system includes a pump, a gas separator upstream from the pump, a packer above the pump, and a gas evacuation module between the pump and the packer. The packer blocks the movement of gases through the annular space and forms a gas collection space between the packer and the pump. The gas evacuation module is configured to remove gas from the gas collection space and mix the gas with liquid-dominant fluids received from the pump. The gas separator includes an intake configured to receive the two-phase fluids, a gas discharge configured to eject gas-dominant fluids into the annular space, and a liquid discharge configured to provide the pump with liquid-dominant fluids.

15 Claims, 3 Drawing Sheets

(56) References Cited

U.S. PATENT DOCUMENTS

| | | | | |
|---|---|---|---|---|
| 5,553,669 | A | 9/1996 | Trainer | |
| 5,660,533 | A | 8/1997 | Cartwright | |
| 5,845,709 | A | 12/1998 | Mack et al. | |
| 6,126,416 | A | 10/2000 | Lee | |
| 6,186,227 | B1 | 2/2001 | Vaynshteyn et al. | |
| 6,260,627 | B1 | 7/2001 | Rivas | |
| 6,315,050 | B2 | 11/2001 | Vaynshteyn et al. | |
| 6,357,530 | B1 * | 3/2002 | Kennedy | F04F 5/464 417/108 |
| 6,497,287 | B1 * | 12/2002 | Podio | E21B 43/122 166/370 |
| 6,564,876 | B2 | 5/2003 | Vaynshteyn et al. | |
| 6,684,946 | B2 | 2/2004 | Gay et al. | |
| 6,899,176 | B2 | 5/2005 | Hailey et al. | |
| 7,357,186 | B1 | 4/2008 | Berry | |
| 7,387,158 | B2 | 6/2008 | Murray et al. | |
| 7,461,692 | B1 | 12/2008 | Wang | |
| 7,462,225 | B1 | 12/2008 | Ketter et al. | |
| 7,552,777 | B2 | 6/2009 | Murray et al. | |
| 7,713,035 | B2 | 5/2010 | Ford | |
| 7,841,395 | B2 | 11/2010 | Gay et al. | |
| 8,322,450 | B2 | 12/2012 | Meijer | |
| 8,584,744 | B2 | 11/2013 | Soni et al. | |
| 8,998,586 | B2 | 4/2015 | Muhs | |
| 9,283,497 | B2 | 3/2016 | Wang et al. | |
| 9,447,661 | B2 | 9/2016 | Broussard et al. | |
| 9,447,788 | B2 | 9/2016 | Henry et al. | |
| 9,624,930 | B2 | 4/2017 | Gahlot et al. | |
| 10,167,708 | B2 | 1/2019 | Beveridge | |
| 10,344,580 | B2 | 7/2019 | Williams | |
| 11,098,570 | B2 | 8/2021 | De et al. | |
| 2002/0023750 | A1 | 2/2002 | Lopes et al. | |
| 2003/0192702 | A1 | 10/2003 | Gay et al. | |
| 2004/0020638 | A1 | 2/2004 | Williams | |
| 2004/0129432 | A1 | 7/2004 | Wills et al. | |
| 2004/0131488 | A1 | 7/2004 | Locher | |
| 2005/0199551 | A1 | 9/2005 | Gordon | |
| 2005/0281683 | A1 | 12/2005 | Brown et al. | |
| 2006/0011345 | A1 | 1/2006 | Delaloye et al. | |
| 2008/0093085 | A1 | 4/2008 | Knight et al. | |
| 2008/0110614 | A1 | 5/2008 | Orban | |
| 2009/0065202 | A1 | 3/2009 | Brown et al. | |
| 2009/0178803 | A1 | 7/2009 | Neuroth et al. | |
| 2010/0175869 | A1 | 7/2010 | Cobb | |
| 2010/0206732 | A1 | 8/2010 | Hale | |
| 2011/0024119 | A1 | 2/2011 | Wolf et al. | |
| 2011/0180272 | A1 | 7/2011 | Head | |
| 2012/0057965 | A1 | 3/2012 | Bergamini et al. | |
| 2013/0025865 | A1 | 1/2013 | Knobloch et al. | |
| 2013/0068455 | A1 | 3/2013 | Brown et al. | |
| 2013/0075105 | A1 | 3/2013 | Morton | |
| 2013/0306330 | A1 | 11/2013 | Bishop et al. | |
| 2014/0332239 | A1 | 11/2014 | Porta | |
| 2015/0053394 | A1 | 2/2015 | Reid et al. | |
| 2015/0075772 | A1 | 3/2015 | Saponja et al. | |
| 2015/0098840 | A1 | 4/2015 | Kowalchuk | |
| 2015/0167652 | A1 | 6/2015 | Van et al. | |
| 2015/0204158 | A1 | 7/2015 | Frisby et al. | |
| 2015/0205158 | A1 | 7/2015 | Engel et al. | |
| 2015/0275619 | A1 | 10/2015 | Slup | |
| 2015/0308245 | A1 | 10/2015 | Stewart et al. | |
| 2015/0345276 | A1 | 12/2015 | Jensen | |
| 2016/0003031 | A1 | 1/2016 | Xin et al. | |
| 2016/0130919 | A1 | 5/2016 | Vasques | |
| 2016/0222770 | A1 * | 8/2016 | Kirk | E21B 43/38 |
| 2017/0175468 | A1 | 6/2017 | Vail, III et al. | |
| 2017/0241215 | A1 | 8/2017 | Kleppa | |
| 2017/0292361 | A1 | 10/2017 | Beauquin et al. | |
| 2017/0342798 | A1 | 11/2017 | Wutherich | |
| 2018/0038210 | A1 | 2/2018 | Xiao et al. | |
| 2018/0112509 | A1 | 4/2018 | Saponja et al. | |
| 2018/0171763 | A1 | 6/2018 | Malbrel et al. | |
| 2018/0179852 | A1 | 6/2018 | Hou et al. | |
| 2018/0223642 | A1 | 8/2018 | Zahran | |
| 2018/0298736 | A1 | 10/2018 | Bailey et al. | |
| 2018/0320500 | A1 | 11/2018 | Williams | |
| 2019/0292888 | A1 * | 9/2019 | Archa | E21B 43/122 |
| 2019/0292892 | A1 | 9/2019 | Zahran | |
| 2019/0292893 | A1 | 9/2019 | El-Mahbes et al. | |
| 2020/0032612 | A1 | 1/2020 | Joshi et al. | |
| 2020/0165908 | A1 | 5/2020 | El-Mahbes et al. | |
| 2020/0362683 | A1 | 11/2020 | El Mahbes et al. | |
| 2020/0378235 | A1 | 12/2020 | Gonzales et al. | |
| 2021/0148380 | A1 | 5/2021 | Brown et al. | |
| 2021/0310352 | A1 | 10/2021 | Pelletier et al. | |
| 2021/0348612 | A1 | 11/2021 | Dinkins et al. | |

FOREIGN PATENT DOCUMENTS

| | | | |
|---|---|---|---|
| WO | 2012169904 | A2 | 12/2012 |
| WO | 2021237232 | A1 | 11/2021 |

* cited by examiner

ELECTRIC SUBMERSIBLE PUMP GAS EVACUATION SYSTEM

FIELD OF THE INVENTION

This invention relates generally to the field of downhole pumping systems, and more particularly, but not by way of limitation, to systems and methods for protecting downhole tubulars and equipment from corrosive gases without impairing the performance of the pumping systems.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the wellbore fluids from the subterranean reservoir to a storage facility on the surface. In many cases, the pump assemblies are multi-stage centrifugal pumps that include a plurality of stages, with each stage including a stationary diffuser and a rotary impeller that is connected to a shaft driven by the electric motor.

Wellbore fluids often contain a combination of liquids and gases. Because most downhole pumping equipment is primarily designed to recover liquids, excess amounts of gas in the wellbore fluid can present problems for downhole equipment. For the centrifugal pump to operate, the pump must maintain its "prime," in which fluid is located in and around the "eye," or central intake portion, of the first impeller of the pump or gas separator. If, for example, a gas slug moves through the well to the pump intake, the pump may lose its prime and will thereafter be unable to pump liquids while gas remains around the eye of the impeller.

A PRIOR ART pumping system 200 is illustrated in FIG. 1. The pumping system 200 is installed in a well 202 that produces hydrocarbons with an elevated concentration of hydrogen sulfide ($H_2S$), which can be corrosive to production tubing 204 and casing 206. The pumping system 200 includes a motor 208, a seal section 210, a gas separator 212 and a pump 214. To mitigate the impact of hydrogen sulfide on the production tubing 204 and other equipment in the well, the pumping system 200 also includes a packer 216 or other zonal isolation mechanism that is installed above the pump 214. The packer 216 prevents the corrosive gas from prolonged contact with the production tubing 204 and casing 206.

Although effective at mitigating corrosion, the packer 216 frustrates the use of the gas separator 212 because gas expelled by the gas separator 212 is trapped in the annular space below the packer 216. Over time, gas accumulates in the annulus below the packer 216 until it reaches the pump 214 and gas separator 212. The presence of accumulated gas at the intake to the gas separator 212 or pump 214 could create a gas lock condition in which the pump 214 loses prime or fails to function efficiently.

Without the gas separator 212, however, the gas produced by the well 202 is removed through the pumping system 200. The elevated gas fraction of the wellbore fluids reduces the efficiency of the pump 214. There is, therefore, a need for an improved system that mitigates the corrosive effect of hydrogen sulfide gas on downhole tubulars without impairing the efficiency of the pump 214. It is to these and other deficiencies in the prior art that the disclosed embodiments are directed.

SUMMARY OF THE INVENTION

In one aspect, the present disclosure is directed to a pumping system deployed in a wellbore for producing two-phase fluids through production tubing to a wellhead, where the wellbore includes an annular space surrounding the pumping system and the production tubing. The pumping system includes a pump, a gas separator upstream from the pump, a packer above the pump, and a gas evacuation module between the pump and the packer. The packer blocks the movement of gases through the annular space and forms a gas collection space between the packer and the pump. The gas evacuation module is configured to remove gas from the gas collection space and mix the gas with liquid-dominant fluids received from the pump. The gas separator includes an intake configured to receive the two-phase fluids, a gas discharge configured to eject gas-dominant fluids into the annular space, and a liquid discharge configured to provide the pump with liquid-dominant fluids.

In another aspect, the present disclosure is directed to a pumping system deployed in a wellbore for producing two-phase fluids through production tubing to a wellhead, where the wellbore includes an annular space surrounding the pumping system and the production tubing. In these embodiments, the pumping system includes a pump and a gas separator upstream from the pump. The gas separator includes an intake configured to receive the two-phase fluids, a gas discharge configured to eject gas-dominant fluids into the annular space, and a liquid discharge configured to provide the pump with liquid-dominant fluids. The pumping system further includes a packer above the pump. The packer forms a gas collection space in the annular space between the packer and the pump. The pumping system also includes a gas evacuation module between the pump and the packer. The gas evacuation module includes a body, an inlet having an inlet diameter, an outlet having an outlet diameter, and a central passage extending through the body. The central passage has a throat between the inlet and the outlet and wherein the throat has a throat diameter that is smaller than the inlet diameter and the outlet diameter. The gas evacuation module further includes one or more gas intake ports that extend through the body to the central passage.

In yet another aspect, the present disclosure is directed to a method for producing two-phase fluids from a wellbore with a pumping system that is connected to production tubing, where the pumping system includes a pump, a gas separator, and a packer positioned above the pump and the gas separator. The method includes the steps of ingesting the two-phase fluids into the gas separator, separating gases from liquids with the gas separator, ejecting gases from the gas separator into an annular space in the wellbore surrounding the pumping system, and providing the pump with liquids separated by the gas separator. The method continues with the steps of allowing the gases in the annular space to collect in a gas collection space below the packer and removing gases from the gas collection space through a gas evacuation module connected to the production tubing.

WRITTEN DESCRIPTION

As used herein, the term "petroleum" refers broadly to all mineral hydrocarbons, such as crude oil, gas and combinations of oil and gas. The term "two-phase" refers to a fluid that includes a mixture of gases and liquids. It will be appreciated by those of skill in the art that, in the downhole environment, a two-phase fluid may also carry solids and suspensions. Accordingly, as used herein, the term "two-phase" is not exclusive of fluids that contain liquids, gases, solids, or other intermediary forms of matter.

Figure 1:
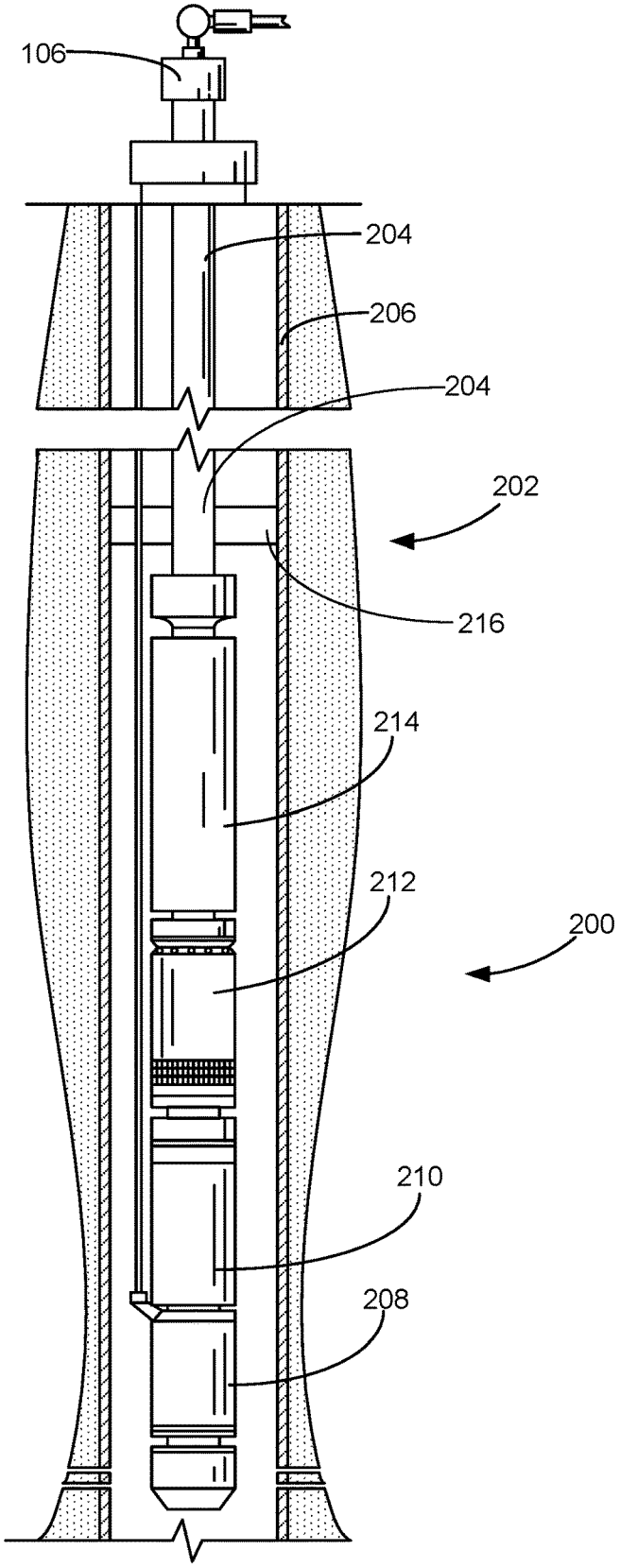
PRIOR ART FIG. 1
FIG. 1 is an elevational view of a PRIOR ART electric submersible pumping system disposed in a wellbore constructed in accordance with an embodiment of the present disclosure.
Figure 2:
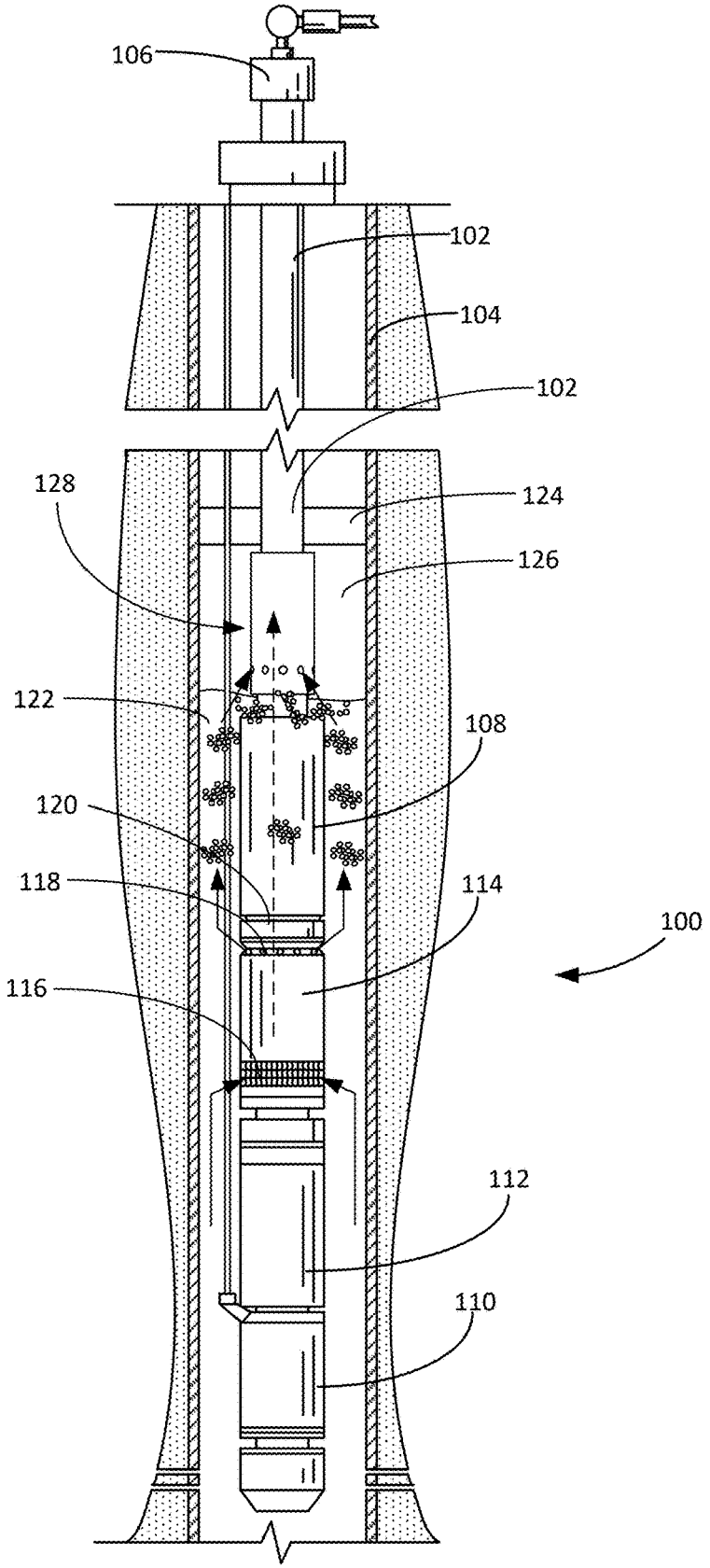
FIG. 2 is an elevational view of an electric submersible pumping system disposed in a wellbore constructed in accordance with an embodiment of the present disclosure.

FIG. 2 shows an elevational view of a pumping system 100 attached to production tubing 102. The pumping system 100 and production tubing 102 are disposed in a cased wellbore 104, which is drilled for the production of a fluid such as water or petroleum. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

For the purposes of the disclosure herein, the terms "upstream" and "downstream" shall be used to refer to the relative positions of components or portions of components with respect to the general flow of fluids produced from the wellbore. "Upstream" refers to a position or component that is passed earlier than a "downstream" position or component as fluid is produced from the wellbore 104. The terms "upstream" and "downstream" are not necessarily dependent on the relative vertical orientation of a component or position. It will be appreciated that many of the components in the pumping system 100 are substantially cylindrical and have a common longitudinal axis that extends through the center of the elongated cylinder and a radius extending from the longitudinal axis to an outer circumference. Objects and motion may be described in terms of radial positions within discrete components in the pumping system 100.

The pumping system 100 includes some combination of a pump 108, a motor 110, and a seal section 112. The seal section 112 shields the motor 110 from mechanical thrust produced by the pump 108 and provides for the expansion of motor lubricants during operation. The pump 108 may include two or more separate pumps that are each connected to one another. In exemplary embodiments, the pump 108 is a multistage centrifugal pump that includes a plurality of stages that each include an impeller and a diffuser.

The pumping system 100 also includes a gas separator 114 positioned upstream from the pump 108. The gas separator 114 can be connected between the seal section 112 and the pump 108. The gas separator 114 includes an intake 116, an internal mechanism for separating liquids and gasses, a gas discharge 118, and a liquid discharge 120. Two-phase wellbore fluids are drawn into the intake 116 of the gas separator 114, where the gaseous components are separated from liquid components using paddles, agitators, spiraled flights, or other mechanisms for inducing rotation within the two-phase fluid so that denser liquid-dominant fluids are pulled outward under centrifugal force, while lighter gaseous fluids remain in the central portion of the gas separator 114. The gaseous components can be collected by a crossover and ejected through the gas discharge 118 into an annular space 122 in the wellbore 104, while the liquid components are carried to the pump 108 through the liquid discharge 120. It will be understood that the components of the gas separator 114 may be integrated into the pump 108 rather than presented as a separate component. It will be further understood that in certain embodiments, the pumping system 100 may include multiple gas separators 114, which may be connected together in a tandem configuration or separated by other components within the pumping system 100.

To reduce the impact of corrosive gases on the production tubing 102 and cased wellbore 104, the pumping system 100 includes a packer 124 or other zonal isolation device. The packer 124 is installed in the annular space 122 above the pumping system 100 in the wellbore 104. The packer 124 generally prevents the passage of fluid through the annular space 122, while providing passages for accessories, power cables and the production tubing 102. Gases moving through the annular space 122 below the packer 124 are collected in a gas collection space 126 within the annular space 122 below the packer 124.

The pumping system 100 further includes a gas evacuation module 128. In the embodiment depicted in FIG. 2, the gas evacuation module 128 is positioned between the packer 124 and the pump 108. In exemplary embodiments, the gas evacuation module 128 is connected between the production tubing 102 and the discharge of the pump 108. In some embodiments, the gas evacuation module 128 is connected between segments of the production tubing 102 and located inside the gas collection space 126. As explained below, the gas evacuation module 128 is generally configured to draw gas from the gas collection region 126 and inject the gas into the liquid-dominant production stream moving through production tubing 102 downstream from the pump 108.

Figure 3:
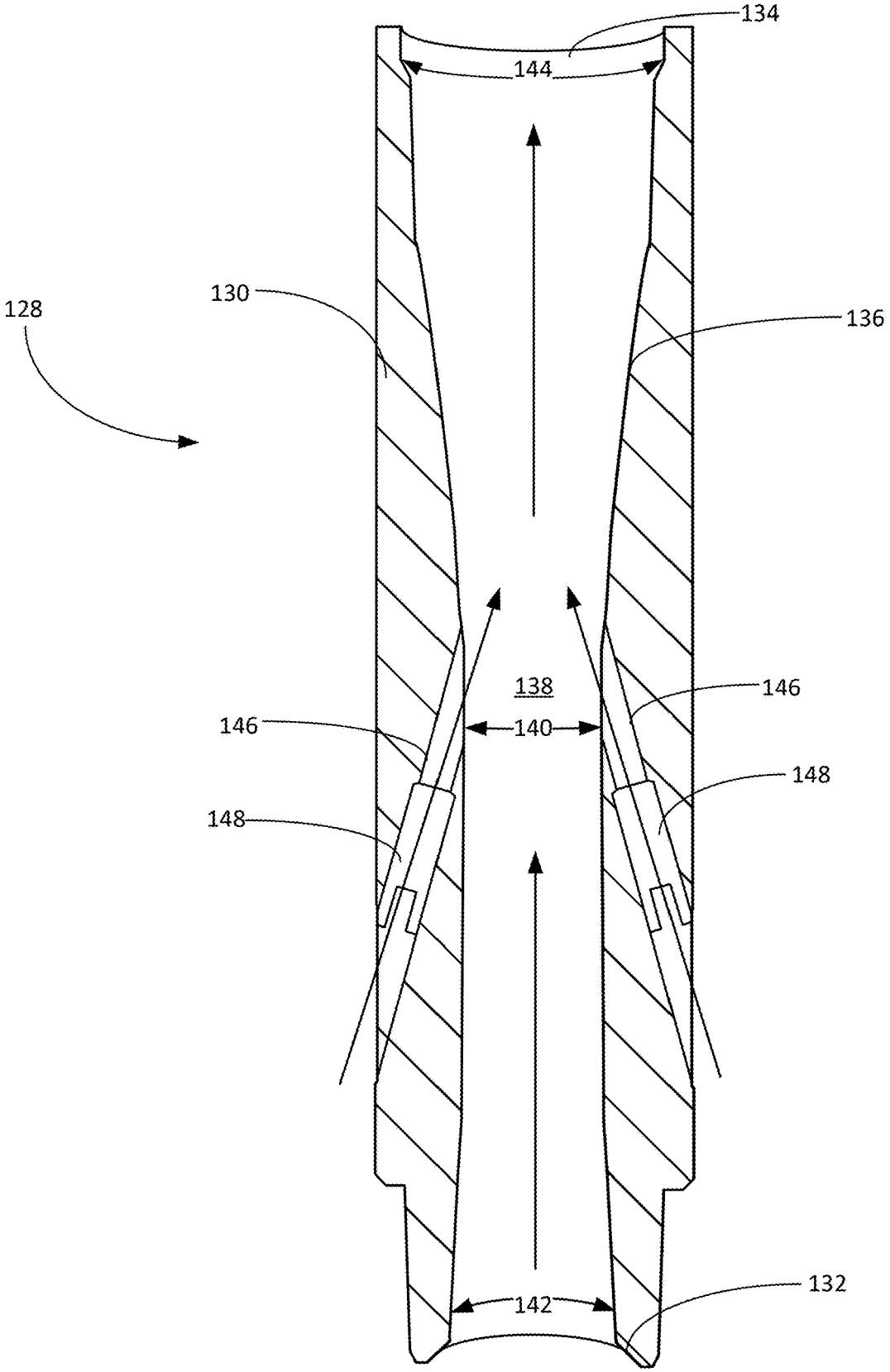
FIG. 3 provides a cross-sectional depiction of the gas evacuation module of the electric submersible pumping system of FIG. 2.

Turning to FIG. 3, shown therein is a cross-sectional view of an exemplary embodiment of the gas evacuation module 128. The gas evacuation module 128 includes a generally cylindrical body 130 that is configured for a conventional connection (e.g., pinned or threaded) with the production tubing 102 or pump 108. The gas evacuation module 128 includes an inlet 132, an outlet 134 and a central passage 136 connected between the inlet 132 and the outlet 134. The central passage 136 includes a throat 138 between the inlet 132 and the outlet 134, where the throat 138 has a smaller throat diameter 140 that is smaller than an inlet diameter 142 and an outlet diameter 144. In this way, the gas evacuation module 128 is configured as a Venturi nozzle in which fluids passing through the gas evacuation module 128 accelerate as they move through the smaller cross-sectional area of the throat 138. The acceleration of fluids moving through the throat 138 creates a localized reduction in pressure in accordance with well-established Bernoulli mechanics.

The gas evacuation module 128 also includes one or more gas intake ports 146. The gas intake ports 146 extend through the body 130 from the throat 138 to the outer surface of the gas evacuation module 128. In the embodiment depicted in FIG. 3, the gas intake ports 146 are angularly disposed such that each gas intake port 146 has a central axis that forms an acute angle with a longitudinal axis passing through the center of the central passage 136.

Each gas intake port 146 optionally includes a check valve 148. In some embodiments, the check valves 148 are configured to prevent the discharge of fluids from the gas evacuation module 128 into the annular space 122 through the gas intake ports 146. In other embodiments, the check valves 148 are configured to open when the pressure differential between the annular space 122 and the throat 138 exceeds a threshold valve opening pressure differential. In exemplary embodiments, the threshold valve opening pressure differential is selected by determining the anticipated pressure drop within the throat 138 of the gas evacuation module 128 and the anticipated pressure in the gas collection space 126 when the gas collection space 126 is maintained above the pump 108. In this way, the check valves 148 can be configured to open before the pressure in the gas collection space 126 increases to an extent that the gas collection space 126 displaces enough fluid from the annular space 122 that gas could be drawn into the gas separator 114 or pump 108. In some embodiments, the check valves 148 are configured to prevent liquids from entering the gas evacuation module 128. In other embodiments, the check valves 148 are configured to selectively admit two-phase fluids into the gas evacuation module 128. The check valves 148 can be manufactured according to applicable standards issued by the National Association of Corrosion Engineers (NACE).

During use, liquid-dominant fluids pumped through the gas evacuation module 128 create a low pressure region within the throat 138 that encourages the check valves 148 to open when a sufficient pressure is present in the surrounding gas collection space 126. Once the check valves 148 open, gas accumulated within the gas collection space 126 is drawn into the gas evacuation module 128 through the gas intake ports 146 and mixed within liquid-dominant fluids from the inlet 132. The mixed-phase fluids are then pumped to the surface through the production tubing 102.

In this way, the pumping system 100 provides a system in which gases, including hydrogen sulfide gas, are expelled into the annular space 122 by the gas separator 114 to improve the operational efficiency of the pump 108. The gases move upward through the annular space 122 and collect in the gas collection space 126 under the packer 124. The gases are then drawn out of the gas collection space 126 by the gas evacuation module 128, mixed with liquid-dominant fluid discharged by the pump 108, and moved to the wellhead 106 through the production tubing 102 as a mixed-phase fluid. The pumping system 100 thereby protects a large portion of the production tubing 102 and other downhole equipment from corrosive wellbore gases without sacrificing the operational efficiency of the pump 108, and without increasing the risk of gas locking the pump 108 with the accumulation of gases in the annular space 122 under the packer 124.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A pumping system deployed in a wellbore for producing two-phase fluids through production tubing to a wellhead, wherein the wellbore includes an annular space surrounding the pumping system and the production tubing, the pumping system comprising:

a pump;

a gas separator upstream from the pump, wherein the gas separator comprises:

an intake configured to receive the two-phase fluids;

a gas discharge configured to eject gas-dominant fluids into the annular space; and a liquid discharge configured to provide the pump with liquid-dominant fluids;

a packer above the pump, wherein the packer blocks the movement of gases through the annular space and wherein the packer forms a gas collection space between the packer and the pump; and a gas evacuation module between the pump and the packer, wherein the gas evacuation module is configured to remove gas from the gas collection space and mix the gas with liquid-dominant fluids received from the pump, wherein the gas evacuation module further comprises:

a body;

an inlet having an inlet diameter;

an outlet having an outlet diameter;

a central passage extending through the body, wherein the central passage comprises a throat between the inlet and the outlet and wherein the throat has a throat diameter that is smaller than the inlet diameter and the outlet diameter; and one or more gas intake ports that extend through the body to the central passage, wherein the one or more gas intake ports each intersect the central passage at the throat.

2. The pumping system of claim 1, wherein each of the one or more gas intake ports includes a check valve that is configured to selectively open and permit the passage of gas from the gas collection space to the throat when a threshold valve opening differential pressure is present between the throat and the gas collection space.

3. The pumping system of claim 1, wherein each of the one or more gas intake ports includes a check valve that is configured to prevent the movement of fluids from the central passage to the gas collection space.

4. The pumping system of claim 1, further comprising:

a motor configured to drive the pump; and a seal section between the motor and the pump.

5. The pumping system of claim 4, wherein the seal section is positioned between the gas separator and the motor.

6. A method for producing two-phase fluids from a wellbore with a pumping system that is connected to production tubing, where the pumping system includes a pump, a gas separator, and a packer positioned above the pump and the gas separator, the method comprising the steps of:

ingesting the two-phase fluids into the gas separator;

separating gases from liquids with the gas separator;

ejecting gases from the gas separator into an annular space in the wellbore surrounding the pumping system;

providing the pump with liquids separated by the gas separator;

allowing the gases in the annular space to collect in a gas collection space below the packer;

providing a gas evacuation module connected to the production tubing, wherein the gas evacuation module includes one or more check valves that have been calibrated to open a threshold pressure differential reached before the gases in the gas collection space become pressurized to an extent that the gases in the gas collection space reach the pump; and removing gases from the gas collection space through the gas evacuation module.

7. The method of claim 6, further comprising the step of pumping the liquids provided by the gas separator with the pump.

8. The method of claim 7, further comprising the step of mixing the gases from the gas collection space with liquids from the pump in the gas evacuation module.

9. The method of claim 8, wherein the step of mixing the gases from the gas collection space with liquids from the pump further comprises mixing the gases from the gas collection space with liquids from the pump in a venturi nozzle inside the gas evacuation module.

10. The method of claim 9, further comprising the step of removing the mixture of gases and liquids from the wellbore through production tubing connected to the gas evacuation module.

11. A pumping system deployed in a wellbore for producing two-phase fluids through production tubing to a wellhead, wherein the wellbore includes an annular space surrounding the pumping system and the production tubing, the pumping system comprising:

a pump;

a gas separator upstream from the pump, wherein the gas separator comprises:

an intake configured to receive the two-phase fluids;

a gas discharge configured to eject gas-dominant fluids into the annular space; and a liquid discharge configured to provide the pump with liquid-dominant fluids;

a packer above the pump, wherein the packer forms a gas collection space between the packer and the pump; and a gas evacuation module between the pump and the packer, wherein the gas evacuation module comprises:

a body;

an inlet having an inlet diameter;

an outlet having an outlet diameter;

a central passage extending through the body, wherein the central passage comprises a throat between the inlet and the outlet and wherein the throat has a throat diameter that is smaller than the inlet diameter and the outlet diameter; and one or more gas intake ports that extend through the body to the central passage, wherein each of the one or more gas intake ports is angularly disposed relative to the central passage such that intake port axes extending through the one or more gas intake ports intersect a central passage axis extending through the central passage at an acute angle, and wherein the one or more gas intake ports intersect the central passage in proximity to the throat, and wherein each of the one or more gas intake ports includes a check valve that is configured to prevent the movement of fluids from the central passage to the gas collection space.

12. The pumping system of claim 11, wherein each check valve is configured to selectively open and permit the passage of gas from the gas collection space to the throat when a threshold valve opening differential pressure is present between the throat and the gas collection space.

13. The pumping system of claim 11, wherein the gas evacuation module is configured to remove gas from the gas collection space and mix the gas with liquid-dominant fluids received from the pump.

14. The pumping system of claim 11, further comprising:

a motor configured to drive the pump; and a seal section between the motor and the pump.

15. The pumping system of claim 14, wherein the seal section is positioned between the gas separator and the motor.

* * * * *